US011019888B2

(12) United States Patent
Newson

(10) Patent No.: US 11,019,888 B2
(45) Date of Patent: Jun. 1, 2021

(54) SUITCASE EQUIPPED WITH A ZIPPER LOCK FASTENER DEVICE

(71) Applicant: LOUIS VUITTON MALLETIER, Paris (FR)

(72) Inventor: Marc Newson, London (GB)

(73) Assignee: LOUIS VUITTON MALLETIER, Paris (FR)

( * ) Notice: Subject to any disclaimer, the term of this patent is extended or adjusted under 35 U.S.C. 154(b) by 222 days.

(21) Appl. No.: 16/065,645

(22) PCT Filed: Dec. 21, 2016

(86) PCT No.: PCT/FR2016/053622

§ 371 (c)(1),
(2) Date: Jun. 22, 2018

(87) PCT Pub. No.: WO2017/109418

PCT Pub. Date: Jun. 29, 2017

(65) Prior Publication Data

US 2018/0368536 A1 Dec. 27, 2018

(30) Foreign Application Priority Data

Dec. 24, 2015 (FR) ..... 15 63298

(51) Int. Cl.
*A44B 19/30* (2006.01)
*A45C 13/10* (2006.01)
(Continued)

(52) U.S. Cl.
CPC ..... *A44B 19/301* (2013.01); *A45C 5/03* (2013.01); *A45C 13/005* (2013.01);
(Continued)

(58) Field of Classification Search
CPC ... A44B 19/301; A45C 19/301; A45C 13/103; A45C 13/18; A45C 13/10; A45C 13/005; E05B 65/52
(Continued)

(56) References Cited

U.S. PATENT DOCUMENTS 1,680,652 A 8/1928 Walinsky
2,032,019 A 2/1936 Jordan
(Continued)

FOREIGN PATENT DOCUMENTS

CA 2850675 A1 10/2015
CN 2154609 Y 2/1994
(Continued)

OTHER PUBLICATIONS

International Search Report for International application No. PCT/FR2016/053622, dated Mar. 14, 2017, 3 pages.
(Continued)

*Primary Examiner* — James N Smalley
*Assistant Examiner* — Jennifer Castriotta
(74) *Attorney, Agent, or Firm* — Reising Ethington P.C.

(57) ABSTRACT

A suitcase that includes an enclosure defining an inner volume, a zipper fastener, and a lock device. The zipper fastener extends along a junction plane and has a first strip presenting a first edge, a second strip presenting a second edge, a slider, and a pull tab connected to the slider. The slider is movable between a fastening position and a releasing position. The lock device is fixed to the enclosure and is adapted for cooperating with the pull tab in a locked position in order to maintain the slider in the fastening position, wherein, in the fastening position, the lock device and the pull tab are arranged in the junction plane.

10 Claims, 5 Drawing Sheets

(51) Int. Cl.
*A45C 13/18* (2006.01)
*A45C 5/03* (2006.01)
*A45C 13/00* (2006.01)

(52) U.S. Cl.
CPC ..... *A45C 13/103* (2013.01); *A45C 13/18* (2013.01); *A45C 2005/037* (2013.01)

(58) Field of Classification Search
USPC ..... 190/120, 101, 903, 901; 70/67–71, 284, 70/285, 312
See application file for complete search history.

(56) References Cited

U.S. PATENT DOCUMENTS

| | | | | | |
|---|---|---|---|---|---|
| 2,335,950 | A * | 12/1943 | Lynam | A45C 13/10 | 190/119 |
| 4,817,769 | A * | 4/1989 | Saliba | A44B 19/301 | 190/120 |
| 4,930,323 | A * | 6/1990 | Terada | A44B 19/301 | 70/68 |
| 6,113,268 | A | 9/2000 | Thompson | | |
| 2004/0237605 | A1 | 12/2004 | Lin et al. | | |
| 2011/0142375 | A1* | 6/2011 | Lebow | B65D 55/145 | 383/64 |
| 2014/0060988 | A1* | 3/2014 | Lai | A45C 13/18 | 190/101 |
| 2015/0300049 | A1* | 10/2015 | Majeau | A44B 19/301 | 70/71 |

FOREIGN PATENT DOCUMENTS

| | | | |
|---|---|---|---|
| EP | 0402949 | A1 | 12/1990 |
| EP | 0411983 | A1 | 2/1991 |
| EP | 2926679 | A1 | 10/2015 |
| JP | 60179766 | U | 11/1985 |
| JP | 200681822 | A | 3/2006 |
| JP | 2007289337 | A | 11/2007 |
| WO | WO9944460 | A1 | 9/1990 |
| WO | 2010105297 | A1 | 9/2010 |

OTHER PUBLICATIONS

Written Opinion for International application No. PCT/FR2016/053622, dated Mar. 14, 2017, 9 pages.
Japan Patent Office, Office Action in counterpart Japanese patent application JP2018-533119, dated Nov. 16, 2020, 9 pages (including translation).

* cited by examiner

SUITCASE EQUIPPED WITH A ZIPPER LOCK FASTENER DEVICE

FIELD OF THE INVENTION

The invention relates to a suitcase comprising a fastening system and a lock device intended to maintain the zipper fastening system in a fastening position.

BACKGROUND

A suitcase is already known, particularly from document EP 2 926 679, the suitcase comprising:

- an enclosure defining an inner volume,
- a zipper fastener extending in a junction plane and comprising a first strip presenting a first edge, a second strip presenting a second edge, a slider and a pull tab connected to the slider, the slider is movable between:
  - a fastening position in which the first edge is maintained adjacent to the second edge, and
  - a releasing position in which the zipper fastener releases the first edge in relation to the second edge,
- a lock device fixed to the enclosure and adapted for cooperating with the pull tab in a locked position in order to maintain the slider in the fastening position.

Although such a suitcase is satisfactory, the invention aims to increase the simplicity, reliability and discretion of the lock device.

SUMMARY

In order to reach the aforementioned aims, in accordance with at least some embodiments of the invention, in the fastening position the lock device and the pull tab are arranged at least in part in the junction plane.

Therefore, in the locked position, the pull tab and the lock device are arranged in the extension of the zipper fastener, which makes them less visible. In addition, the pull tab is less likely to be damaged in the event of an impact against another object. In particular, the slider is less likely to undergo stress causing it to displace, and if it does move, the pull tab is subjected to traction and not to torsion, so that it is more likely to resist this impact without being damaged.

According to another embodiment of the invention, preferably the enclosure comprises a first shell, a second shell and a hinge device connecting the first shell and the second shell, the second shell is movable in relation to the first shell between an opened position and a closed position through the hinge device when the slider is in the releasing position, and the suitcase presents a flat surface in which the lock device and the hinge device are arranged.

Therefore, a simple suitcase is formed that can easily be opened by acting on a single slider, and is therefore esthetically pleasing and ergonomic.

According to an additional embodiment of the invention, preferably, in the closed position, the hinge device comprises a rotational axis that is offset in relation to the junction plane.

Therefore, the lock device does not impair the movement of the second shell in relation to the first shell between the opened position and the closed position, without requiring a complex solution or risking damage to the suitcase.

According to another embodiment of the invention, preferably, in the closed position, the rotational axis is offset along a direction perpendicular to the junction plane beyond the part of the lock device situated outside the enclosure.

Therefore, the second shell may be pivoted at least 90 degrees in relation to the first shell between the closed position and the opened position, without having to provide a recess or other complex shape that would risk lessening the esthetic flow of the suitcase and collect dust or gravel likely to impair the pivoting.

According to another embodiment of the invention, preferably the hinge device comprises an intermediate element rotatably hinged in relation to the first shell around a first articulation axis and in relation to the second shell around a second articulation axis, the first articulation axis is parallel to the second articulation axis and the lock device is carried by the intermediate element.

Therefore, the range of motion of the second shell in relation to the first shell without colliding with the lock device is further increased.

According to a further embodiment of the invention, preferably, in the closed position, perpendicular to the junction plane, the lock device presents a part situated outside the enclosure and presents a space width, and the gap distance is equal to or greater than the space width.

Therefore, the second shell may be pivoted at least 180 degrees in relation to the first shell between the closed position and the opened position, without having to provide a recess or other complex shape presenting the aforementioned disadvantages.

According to another embodiment of the invention, preferably, the lock device comprises a plate and a latch, the plate is arranged outside the enclosure and presents a hole, the latch is inside the enclosure, the pull tab comprises a base portion and a lock portion, the pull tab is connected to the slider by the base portion, in the locked position the lock portion is inserted into the hole of the plate and is retained by the latch, and the base portion and the lock portion are each substantially rectilinear and form a substantially right angle in relation to each other.

Therefore, particularly in the locked position, the latch and pull tab have less risk of damage by impact with an external element. In addition, the esthetic flow of the suitcase is not substantially altered by the presence of the lock device or the tongue.

According to an additional embodiment of the invention, preferably the locking portion is in the continuation of the base portion, at the end of which it is connected by a curved portion, the pull tab preferably being formed by a folded plate.

The reliability and esthetic appearance of the suitcase are thereby further increased.

According to yet another embodiment, preferably the base portion of the pull tab is flat and extends parallel to the plate and substantially rests against the plate.

Thus, in the event of an impact against the pull tab, the plate supports the pull tab to reduce the risk of deterioration, particularly the pull tab and the lock device.

According to another embodiment of the invention, preferably, the zipper fastener extends between a first longitudinal end and a second longitudinal end, and the lock device comprises a housing equipped with two slits through which the zipper fastener extends near the first longitudinal end.

Therefore, the slider can come into contact with the lock device in the fastening position, and the first longitudinal end of the zipper is concealed and maintained by a cover.

BRIEF DESCRIPTION OF THE FIGURES

Other characteristics and advantages of the present invention will appear in the following detailed description, with reference to the attached drawings in which.

DETAILED DESCRIPTION OF THE ILLUSTRATED EMBODIMENT

The figures illustrate a suitcase essentially comprising an enclosure 3, a zipper fastener 10 and a lock device 30.

Figure 1:
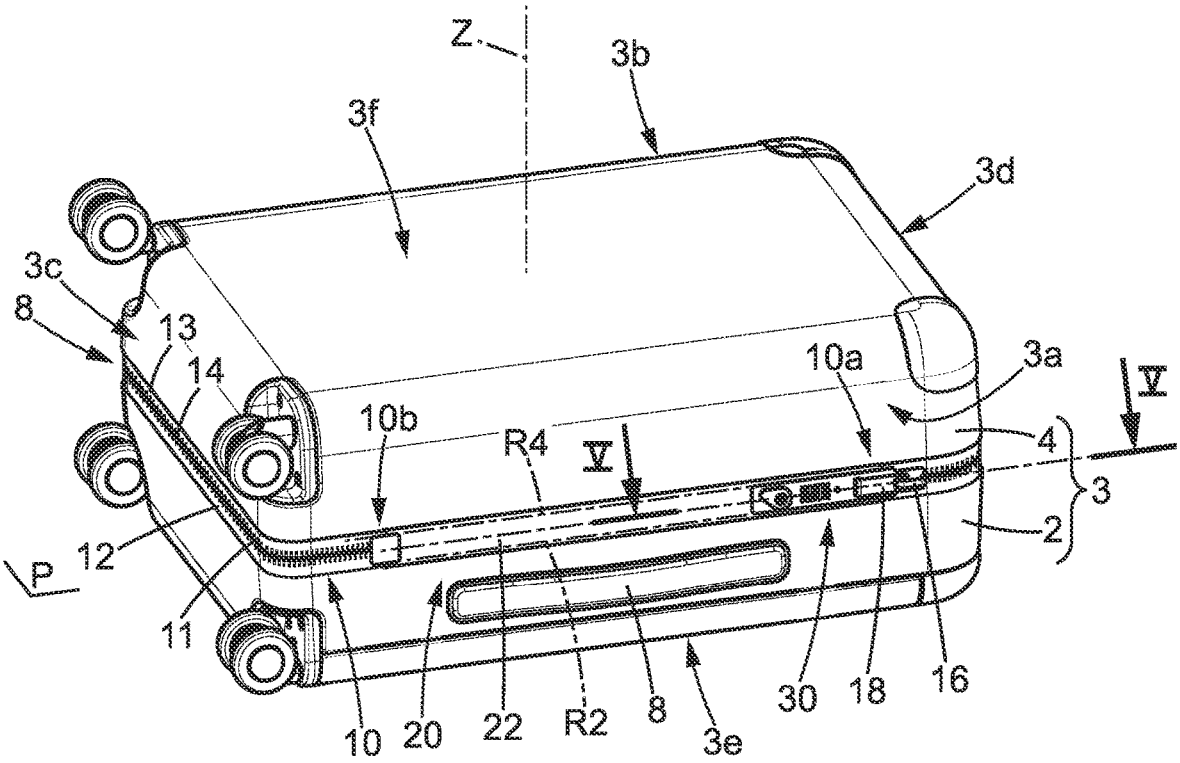
FIG. 1 is a perspective view of a suitcase in accordance with an embodiment of the invention, shown in the closed position.

In the embodiment illustrated, the suitcase defines a suitcase 1. Enclosure 3 comprises a first shell 2 and a second shell 4 connected by a hinge device 20. The first shell 2 and the second shell 4 are relatively rigid. In addition, as illustrated in FIG. 1, enclosure 3 is substantially parallelepiped. The enclosure comprises two large lateral faces 3*a*, 3*b*, two small lateral faces 3*c*, 3*d* (wider dimension), one lower main face 3*e* and one upper main face 3*f*, each of its surfaces being substantially flat.

In addition and optionally, suitcase 1 comprises wheels arranged at the four corners of lateral face 3*c* and a telescopic handle able to project from the lateral face 3*d*. Suitcase 1 also comprises a main carrying handle 8 arranged on the large lateral face 3*a*. In FIG. 1, suitcase 1 is illustrated in the position in which it is intended to rest on a floor in view of its opening, supported on its lower face 3*e*.

Enclosure 3 defines an inner volume 6 intended to receive personal effects to be transported, particularly clothes.

Figure 2:
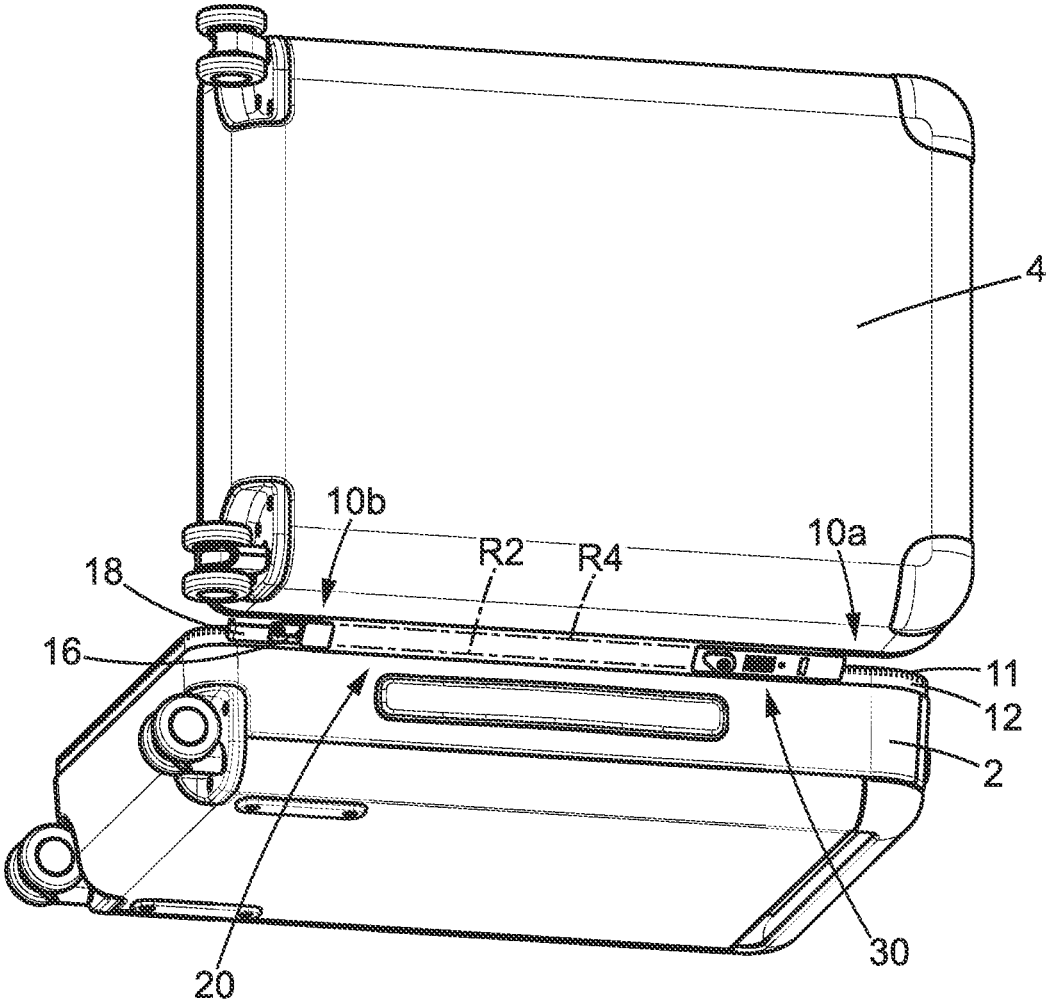
FIG. 2 is a perspective view of the suitcase in the opened position.
Figure 3:
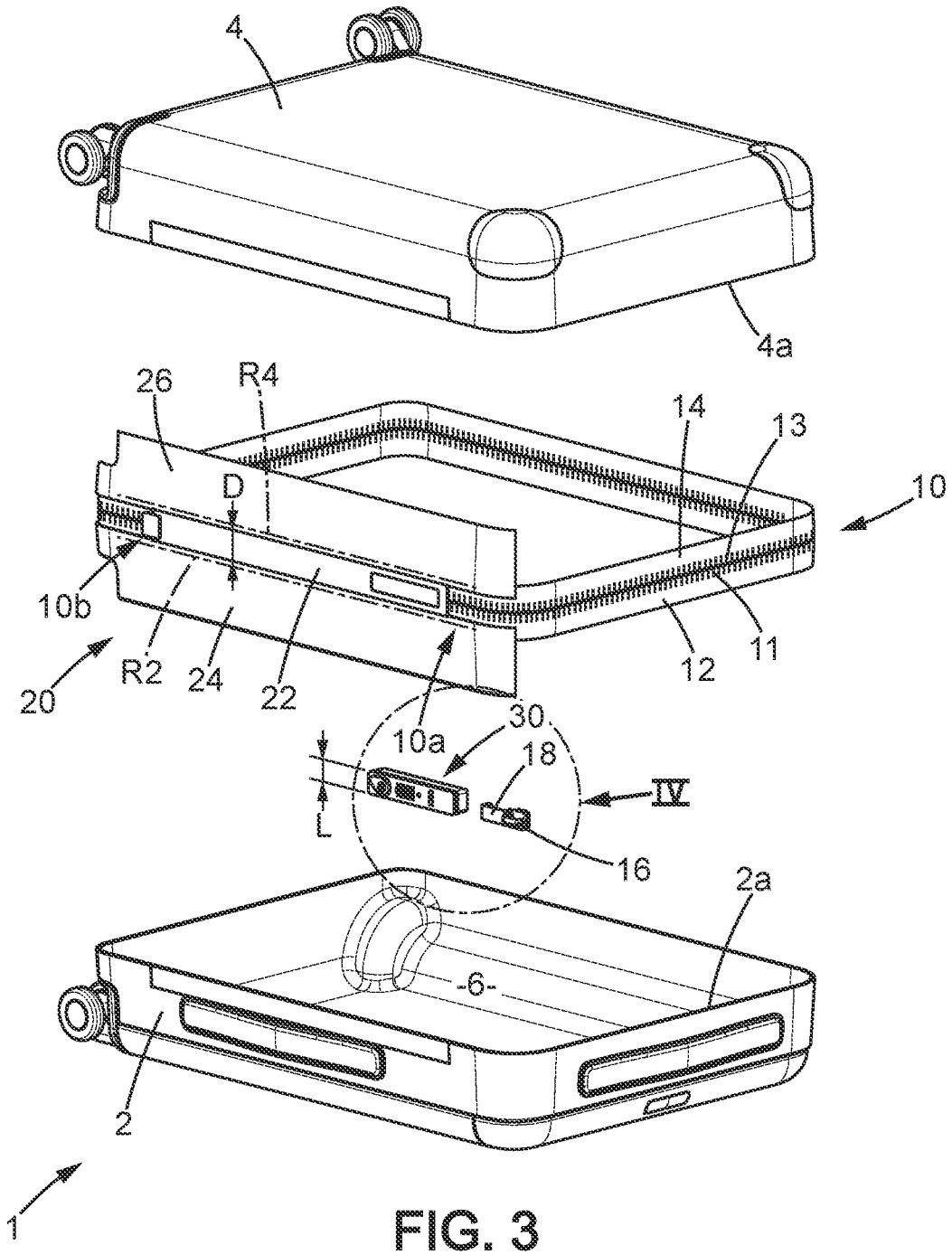
FIG. 3 is an exploded view in perspective of the suitcase.

The first shell 2 and the second shell 4 are connected by a hinge device 20 enabling the first shell 2 and the fourth shell 4 to move in relation to one another between a closed position illustrated in FIG. 1 and the opened position illustrated in FIG. 2. In the closed position illustrated in FIG. 1, the second shell 4 is facing the first shell 2. The second shell 4 presents an edge 4*a* generally in contact with an edge 2*a* of the first shell 2 along a junction plane P. In the opened position, a passage exists between the first shell 2 and the second shell 4 in order to access the inner volume 6 to place personal effects therein.

The hinge device 20 is arranged at the large lateral face 3*a* and essentially comprises a first support 24 fixed to the first shell 2, a second support 26 fixed to the second shell 4 and an intermediate element 22 extending between the first support 24 and the second support 26. The first support 24 and the second support 26 may also be formed in the respective structures of the first shell 2 and the second shell 4, which may, for example, each be molded in a single piece. The intermediate element 22 is rotatably hinged in relation to the first support 24, and consequently to the first shell 2, around a first articulation axis R2. The intermediate element 22 is rotatably hinged in relation to the second support 26, and consequently to the second shell 4, around a second articulation axis R4. The first articulation axis R2 and the second articulation axis R4 both extend parallel to the junction plane P substantially at the large lateral face 3*a* in the closed position of suitcase 1. The first articulation axis R2 and the second articulation axis R4 are consequently parallel and separated from each other by a gap distance D.

In the closed position, the gap distance D extends along a direction of elevation Z perpendicular to the junction plane P and parallel to the large lateral face 3*a*.

In the closed position, the zipper fastener 10 extends between a first longitudinal end 10*a* and a second longitudinal end 10*b*. The first longitudinal end 10*a* and the second longitudinal end 10*b* are both situated at the large lateral face 3*a*. Between the first longitudinal end 10*a* and the second longitudinal end 10*b*, the zipper fastener extends along the junction plane across lateral faces 3*d*, 3*b*, 3*c*.

The zipper fastener 10 comprises a first strip 12 presenting a first longitudinal edge 11, a second strip 14 presenting a second longitudinal edge 13, a slider 16 and a pull tab 18. The slider 16 is adapted to be displaced between a fastening position in which it is near the first longitudinal end 10*a* and a releasing position in which it is near the second longitudinal end 10*b*.

When the slider 16 is in the fastening position, the first longitudinal edge 11 is maintained adjacent to the second longitudinal edge 13. For this purpose, the first longitudinal edge 11 and the second longitudinal edge 13 are provided with complementary teeth alternately arranged on the first longitudinal edge 11 and on the second longitudinal edge 13, as is well known. Alternatively, other types of zipper fasteners can be used.

When the slider 16 is in the releasing position, the first longitudinal edge 11 is released in relation to the second longitudinal edge 13 between the first longitudinal end 10*a* and the second longitudinal end 10*b*.

When the slider 16 is in the fastening position, the suitcase 1 is maintained in the closed position, the second shell 4 being in contact with the first shell 2, so that the inner volume 6 is closed, preventing access. When slider 16 is in the releasing position, the second shell 4 may be displaced from the opened position to the closed position thanks to the hinge device 20, as described previously.

The lock device 30 is arranged in the large lateral face 3*a*, between the first longitudinal end 10*a* and the second longitudinal end 10*b* and in close proximity to the first articulation axis R2 and the second articulation axis R4. More specifically, lock device 30 is arranged in the extension of the zipper fastener 10, at the first longitudinal end 10*a*. When slider 16 is in the fastening position, it substantially rests against lock device 30. Junction plane P extends across the lock device 30.

Lock device 30 comprises an outer part 44 arranged outside enclosure 3 and an inner part 42 arranged inside enclosure 3. The lock device essentially comprises a plate 32, a cover 35, a latch 36, a retractable stop 37, a release pin 38, a control lever 46, a key lock 48 and a combination lock 50.

Plate 32 is substantially flat and essentially comprises a flat plate extending outside the suitcase against the large lateral face 3*a*. The plate 32 forms a housing 40 with the cover 35 arranged inside enclosure 3. The latch 36, the retractable stop 37, the release pin 38, the control lever 46, the key lock 48 and the combination lock 50 are carried by the housing 40, preferably by the plate 32. The latch 36, the retractable stop 37 and the release pin 38 are arranged inside the enclosure 3, so that they are protected behind plate 32.

Figure 5:
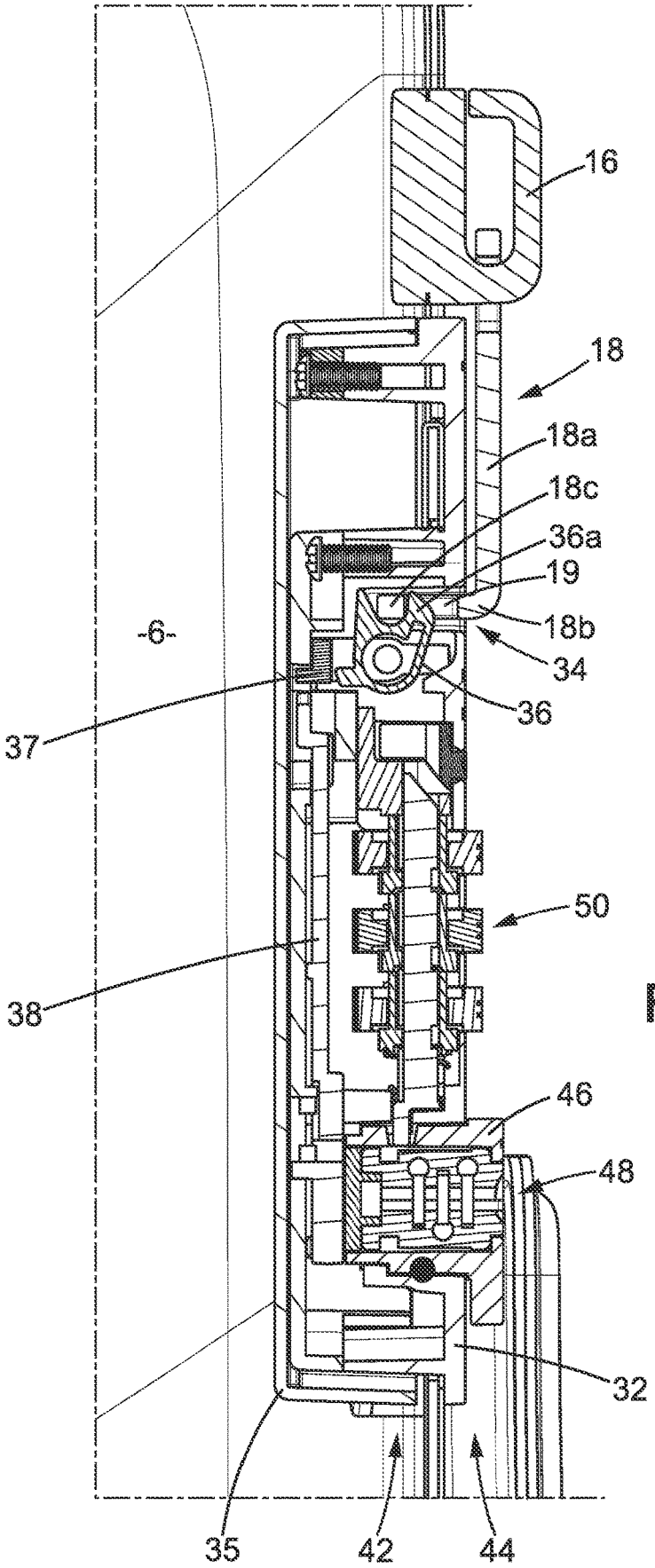
FIG. 5 is a cross sectional view along the line marked V-V in FIG. 1.

The latch 36 presents a catch 36*a* and is mounted movably in rotation, biased in a lock position illustrated in FIG. 5 by a spring. The retractable stop 37 blocks the latch 36 in the lock position by opposing its rotation. The control lever 46, arranged outside the enclosure 3, and connected to a cam, enables the retractable stop 37 to retract via the release pin 38. The key lock 48 and the combination lock 50 inhibit the rotation of the control lever 46.

The pull tab 18 is present in the form of a plate with a substantially constant thickness folded into an L shape. It comprises a base portion 18*a*, a curved portion 18*b*, and a lock portion 18*c*. The pull tab 18 is connected to the slider 16 by the base portion 18*a*. The lock portion 18*c* is cohesive with the base portion 18*a*, at the end of which the lock portion 18*c* is connected through the curved portion 18*b*. The base portion 18*a* and the lock portion 18*c* are each substantially rectilinear and form a substantially right angle in relation to each other.

The lock portion 18*c* presents a locking hole 19. When the slider 18 is in the fastening position, at the first longitudinal end 10*a*, the lock portion 18*c* can be inserted through a hole 34 in the plate 32 in order to place the pull tab 18 in a locked position in which the catch 36*a* of the latch 36 is inserted into the locking hole 19 of the pull tab 18. The pull tab 18 is maintained in this locked position until an action is performed on the control lever 46. The latch 36 then retains the slider 16 in the fastening position via the tongue 18. The base portion 18*a* of the pull tab 18 extends parallel to the plate 32, substantially resting flat against the flat surface of plate 32.

Figure 4:
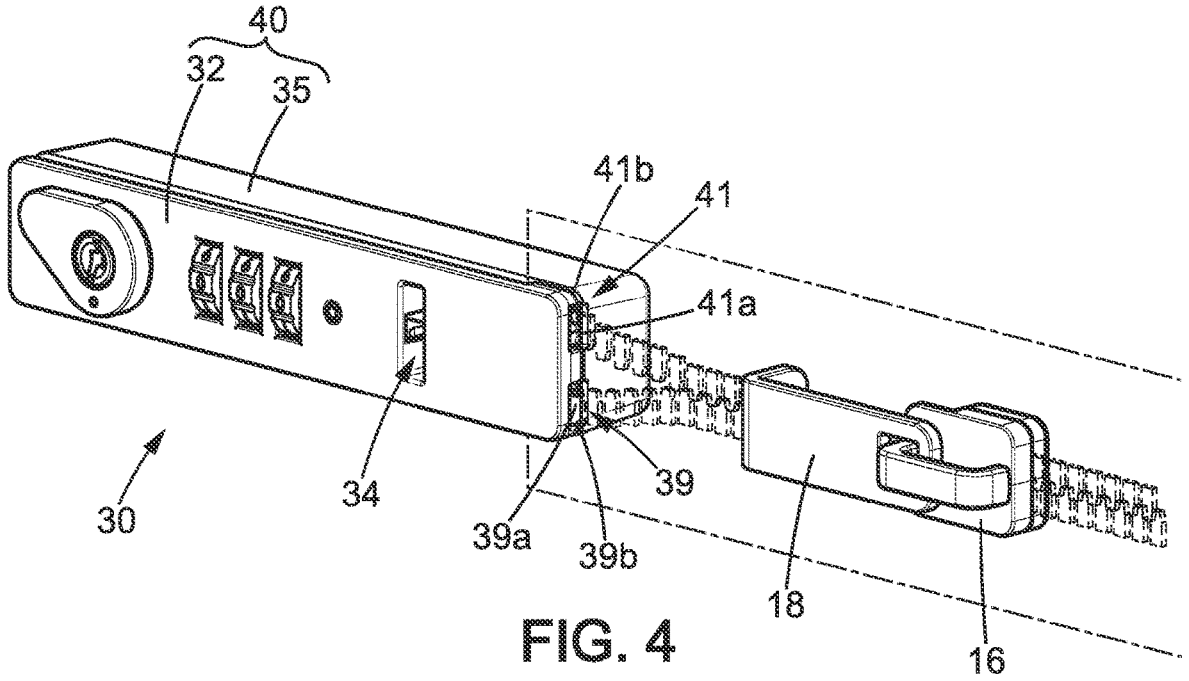
FIG. 4 illustrates the portion marked IV in FIG. 3 in an enlarged scale.

On the other hand, as illustrated in FIG. 4, the housing 40 presents a first slit 39 and a second slit 41 receiving the zipper fastener 10 near the longitudinal end 10*a*. The first slit 39 and the second slit 41 each comprise a narrow part 39*b*, 41*b* and a wider part 39*a*, 41*a*. The narrow part 39*b*, 41*b* of the first slit 39 and the second slit 41 respectively receives the first strip 12 and the second strip 14. The wide part 39*a*, 41*a* of the first slit 39 and the second slit 41 receives teeth from zipper 10 respectively maintained on respectively the first strip 12 and the second strip 14. The first slit 39 and the second slit 41 are advantageously made between the plate 32 and the cover 35, which are fixed to one another, particularly by screwing.

In the embodiment illustrated, the housing 40 of the lock device 30 is carried by the intermediate element 22.

As illustrated in FIG. 1, in the closed position, the first rotational axis R2 is offset in relation to the junction plane P, along the direction of elevation Z perpendicular to the junction plane P beyond the outer part 44 of the lock device 30.

Also, in the closed position, the second rotational axis R4 is offset in relation to the junction plane P, along the direction of elevation Z beyond the outer part 44 of lock device 30.

In the closed position, the outer part 44 of the lock device 30 presents a space width L along the direction of elevation Z. The space width is less than the gap distance D.

Therefore, the outer part 44 of lock device 30 is situated between the first rotational axis R2 and the second rotational axis R4 along the direction of elevation.

Consequently, the lock device 30 does not impair the opening of the suitcase 1.

Of course, the invention is not in any way limited to the embodiment described for illustrative, non-limiting purposes. Therefore, although in the embodiment illustrated, the lock device 30, and particularly the latch 36 are centered in relation to the junction plane P, it may be provided that the major part of lock device 30 is on one side of junction plane P and a small part of lock device 30 is on the other side of junction plane P.

The invention claimed is:

1. A suitcase comprising:

an enclosure defining an inner volume, a zipper fastener extending along a junction plane and comprising a first strip presenting a first edge, a second strip presenting a second edge, a slider, and a pull tab connected to the slider, wherein the slider is movable between:

a fastening position in which the first edge is maintained adjacent to the second edge, and a releasing position in which the zipper fastener releases the first edge in relation to the second edge, a lock device fixed to the enclosure and adapted for cooperating with the pull tab in a locked position in order to maintain the slider in the fastening position, wherein, in the fastening position, the lock device and the pull tab are arranged in the junction plane, wherein the enclosure comprises a first shell, a second shell, and a hinge device connecting the first shell and the second shell, the second shell being movable in relation to the first shell between an opened position and a closed position through the hinge device when the slider is in the releasing position, wherein the suitcase presents a flat surface at which the lock device and the hinge device are arranged, wherein the lock device comprises a plate and a latch, the plate is arranged outside the enclosure and presents a hole, and the latch is inside the enclosure, wherein the pull tab comprises a base portion and a lock portion, and the pull tab is connected to the slider by the base portion, wherein, in the locked position, the lock portion is inserted into the hole of the plate and is retained by the latch, wherein the base portion and the lock portion are each substantially rectilinear and form a substantially right angle in relation to each other, and wherein the hinge device comprises an intermediate element rotatably hinged in relation to the first shell around a first articulation axis and in relation to the second shell around a second articulation axis, the first articulation axis is parallel to the second articulation axis, and the lock device is carried by the intermediate element.

2. The suitcase according to claim 1, wherein, in the closed position, perpendicular to the junction plane:

the lock device presents a part situated outside the enclosure and presenting a space width, the first articulation axis is separated from the second articulation axis by a gap distance, and the gap distance is equal to or greater than the space width.

3. The suitcase according to claim 1 wherein the lock portion is in the continuation of the base portion, at the end of which the lock portion is connected by a curved portion.

4. The suitcase according to claim 1, wherein the base portion of the pull tab is flat and extends parallel to the plate and substantially rests against the plate.

5. The suitcase according to claim 1, wherein:

the zipper fastener extends between a first longitudinal end and a second longitudinal end, and the lock device comprises a housing equipped with two slits through which the zipper fastener extends near the first longitudinal end.

6. The suitcase according to claim 3, wherein the pull tab comprises a folded plate.

7. A suitcase comprising:

an enclosure defining an inner volume, a zipper fastener extending along a junction plane and comprising a first strip presenting a first edge, a second strip presenting a second edge, a slider, and a pull tab connected to the slider, wherein the slider is movable between:

a fastening position in which the first edge is maintained adjacent to the second edge, and a releasing position in which the zipper fastener releases the first edge in relation to the second edge, a lock device fixed to the enclosure and adapted for cooperating with the pull tab in a locked position in order to maintain the slider in the fastening position, wherein, in the fastening position, the lock device and the pull tab are arranged in the junction plane, wherein the enclosure comprises a first shell, a second shell, and a hinge device connecting the first shell and the second shell, the second shell being movable in relation to the first shell between an opened position and a closed position through the hinge device when the slider is in the releasing position, wherein the suitcase presents a flat surface at which the lock device and the hinge device are arranged, wherein the hinge device comprises an intermediate element rotatably hinged in relation to the first shell around a first articulation axis and in relation to the second shell around a second articulation axis, wherein the first articulation axis is parallel to the second articulation axis, wherein the lock device is carried by the intermediate element, and wherein, in the closed position, perpendicular to the junction plane:

the lock device presents a part situated outside the enclosure and presenting a space width, the first articulation axis is separated from the second articulation axis by a gap distance, and the gap distance is equal to or greater than the space width.

8. The suitcase according to claim 7 wherein, in the closed position, the hinge device comprises a rotational axis that is offset in relation to the junction plane.

9. The suitcase according to claim 8 wherein, in the closed position, the rotational axis is offset along a direction perpendicular to the junction plane beyond a part of the lock device situated outside the enclosure.

10. The suitcase according to claim 7, wherein:

the lock device comprises a plate and a latch, the plate is arranged outside the enclosure and presents a hole, and the latch is inside the enclosure, the pull tab comprises a base portion and a lock portion, and the pull tab is connected to the slider by the base portion, in the locked position, the lock portion is inserted into the hole of the plate and is retained by the latch, and the base portion and the lock portion are each substantially rectilinear and form a substantially right angle in relation to each other.

* * * * *